United States Patent [19]

Kankaanpää

[11] 4,128,053

[45] Dec. 5, 1978

[54] SUPERCALENDERS

[75] Inventor: Matti Kankaanpää, Espoo, Finland

[73] Assignee: Valmet Oy, Finland

[21] Appl. No.: 807,298

[22] Filed: Jun. 16, 1977

[30] Foreign Application Priority Data

Jun. 17, 1976 [FI] Finland ..... 761764

[51] Int. Cl.[2] ..... B30B 3/00

[52] U.S. Cl. ..... 100/162 R; 100/160

[58] Field of Search ..... 100/155 R, 161, 162 R, 100/163 R, 163 A, 164, 165, 166, 159, 160, 167, 168, 176, 172, 170

[56] References Cited

U.S. PATENT DOCUMENTS 3,451,331 6/1969 Fredrickson et al. ..... 100/162 R 3,641,928 2/1972 Kraft et al. ..... 100/161

FOREIGN PATENT DOCUMENTS 610,695 3/1935 Fed. Rep. of Germany ..... 100/162 R

*Primary Examiner*—George F. Mautz

*Attorney, Agent, or Firm*—Steinberg & Blake

[57] ABSTRACT

A supercalender wherein a stack of metal rolls form an upright series of metal rolls defining hard nips between themselves. The upright series of metal rolls include top and bottom rolls and between the latter at least a pair of intermediate rolls one of which is an upper intermediate roll situated next to the top roll and the other of which is a lower intermediate roll situated next to the bottom roll. At least one pair of filled rolls are situated next to at least one of said intermediate rolls to define therewith a pair of soft nips.

23 Claims, 8 Drawing Figures

SUPERCALENDERS

BACKGROUND OF THE INVENTION

The present invention relates to paper machines and in particular to supercalenders which are used in connection with paper machines.

Thus, the present invention relates to supercalenders of paper machines utilized for burnishing the paper, such calenders including a plurality of hard or metal rolls and a plurality of soft or filled rolls, the number of which may, for example, be substantially equal to the number of metal rolls. The filled rolls are, for example, paper-coated rolls. Thus, as is well known, the filled rolls are made of a material possessing resilient or elastic properties. The filling of the filled rolls is obtained by compressing fabrics, papers, or nonwoven mats of cellulose fiber under high pressure.

The surface of a paper web manufactured by a paper machine is always more or less uneven and rough after the drying operations have been completed. This unevenness and roughness of the paper surface results from the method by which the web is produced at the wet end of the machine. A wet web formed on a planar wire always has an uneven top surface while its lower surface usually retains a distinct pattern or marking from the wire fabric. The press felts which engage the web also provide at the surface thereof a pattern consistent with the fabric structure of the felts. In addition the lack of evenness of the paper surface results from shrinkage of the paper web as well as from wrinkling thereof during the drying operations.

It is of course well known that the smoothness and gloss of the paper surface are achieved by way of a treatment which takes place after the drying operations, this treatment being carried out by way of a calender. Such a calender will normally include a stack of rolls which are supported for rotation and situated one above the other in a suitable vertical frame with the rolls resting against each other while the web which is treated is conducted through pressure zones or nips defined between the stack of rolls, the web usually travelling from the top toward the bottom of the stack.

The smoothing and burnishing action resulting from the calendering is mainly the result of the compressing and deformation action to which the paper web is subjected in the nips between the calender rolls. In addition, between the web and the surface of the calender rolls there is a greater or lesser differential velocity or slip, producing a friction which promotes the burnishing of the paper, this friction acting on the paper in addition to the effect of the compression of the paper at the nips between the rolls.

The purpose of calendering is to influence even additional paper properties, which is to say in addition to the smoothness and the gloss of the paper surface. Thus, one of the important functions of calendering is to impart to the paper a predetermined thickness or caliper, and in this connection the calendering action should eliminate thickness variations, if any. During treatment in a calender, the thickness of the paper web is reduced, and in a corresponding manner the density of the paper is increased while at the same time the paper web becomes more plastic or pliable.

As is known, calendering is carried out either with a paper machine calender situated in the paper machine between the drying cylinder section and the reeling apparatus, or the calendering is carried out by way of a supercalender which in the past has been in the form of a separate unit utilized for treating paper subsequent to manufacture thereof at a paper machine proper.

The machine calender forms an essential component of most machines for manufacturing paper or cardboard. All of the rolls of such calender are metal rolls made of die-cast steel, for example, and the primary task of such machine calenders, for example in a newsprint machine, is not at all to provide a hard gloss but rather to compress the dry paper web so that it will have a uniform thickness and smoothness over the entire width of the paper web. In a cardboard machine also the primary task of the machine calender is to compress the cardboard web to a predetermined thickness or caliper, while the cardboard also may be burnished on one or both sides. Relatively large cardboard machines require two and in some cases even three consecutive calenders.

Supercalenders, however, are only suitable for burnishing and compacting the paper web. The rolls of supercalenders are alternately metal rolls, such as hard, ground steel rolls, and filled rolls such as, for example, papercoated rolls having a resilient surface. A supercalender may have up to 20 rolls. Moreover, supercalenders are capable of being easily damaged and cannot be operated directly at and connected to the paper machine. Such supercalenders operate separately from the paper machine.

Calendering is particularly necessary in connection with the manufacture of writing and printing papers. In the case of writing papers and papers primarily intended to have text printed thereon, a machine calender treatment may be adequate. If the printing work includes accurate printing of illustrations or printing in several colors, then a high degree of surface smoothness is required for the paper as well as a glossy surface at the same time. In this case smoothing and burnishing treatment by way of a supercalender is essential.

The effect of calendering on a web is dependent upon a large number of factors which include the number of nips, the temperature of the rolls, the moisture content of the paper and the moisture distribution in the web cross section, the machine speed, and the pressure per unit area in the press nip. This latter factor is dependent upon the line pressure, the diameter of the rolls, and the thickness of the web.

The line pressure in a calender must not exceed an empirically determined limit for each particular type of paper. In the event that the line pressure is excessive, the web may be crushed or otherwise damaged and spoiled. In order to avoid this latter drawback and in order to achieve a calendering of adequate efficiency, a very large number of nips is required in certain cases. In a conventional calender where the rolls are usually situated so as to rest freely one upon the other, certain problems of construction and paper technology are taken care of. Thus the nip loading will increase naturally from the top toward the bottom, consistent with the weight of the rolls and their bearings. This will result in deflection of the lower rolls and in an excessive increase of the line pressure which must be eliminated by way of special roll constructions and special arrangements.

It is important that the line pressure at each nip of the calender be as uniform as possible across the web. In order to achieve this latter uniformity in the line pressure it is known to compensate for deflection of the rolls by way of crowning or bulging at the roll surface, brought about by grinding the rolls so that they are somewhat of a slightly barrel shaped configuration. In other words the diameter of such a roll gradually increases from the end toward the center of the roll. The deflection of a roll under different loading conditions can be calculated from the dimensions of the roll, the load forces acting thereon, the density of the roll material, and its modulus of elasticity. In a multiple roll calender the crowning or bulging problem is of considerably greater complexity than in a press made up of only one pair of rolls.

In order to reduce problems in connection with bulging or crowning of the rolls, it is possible to utilize in a calender specially designed rolls which are compensated with respect to deflection and the deflection of which may be regulated so as to be adapted for a particular load. It is also possible to provide suitable weight-relief means for the rolls.

In conventional calender apparatus, there are a number of drawbacks and deficiencies, which include, among others, the following:

It is not possible to achieve a high gloss with the machine calender. Thus, for this purpose a separate supercalender is required, and such a separate supercalender of necessity occupies an undesirably large amount of space and carries with it high construction costs.

The care and operation of a supercalender necessitates a team of its own, so that high labor costs are involved.

The starting up of a supercalender either at the beginning of a calendering operation or in the event of a web break is cumbersome and cannot be carried out at high speed.

Control of uniform line pressure at the calender nips is cumbersome, particularly in connection with calenders which have a large number of rolls. As a result such structures utilize several complex arrangements in connection with loading of the calender rolls, and a large number of expensive deflection-compensated rolls are required.

The roll stack of a conventional supercalender is arranged so that all of the rolls, namely the metal as well as the filled rolls, are situated vertically one above with the other with their axes in a common vertical plane. In the event that such a calender is stopped for a prolonged interval, it is essential to see to it that the resilient surfaces of the filled rolls do not remain under pressure since they may become permanently damaged in this way. Thus, in order to take care of this latter problem, a load-relief system is required.

A further problem encountered during operation of a conventional calender is in connection with the production of so-called lash markings on the paper. Such markings are caused by vibration of the calender, such vibration producing a variation in the line pressure at the nips. The generation of such vibrations can be understood by imagining the calender as a system of mass elements and elastic elements wherein the calender rolls represent the mass elements while the paper at the nips between the rolls represents the elastic spring structure between these masses. The smaller the number of rolls which are stacked one above the other in the calender stack or the greater the diameter of the intermediate rolls which are utilized, the smaller is the likelihood of vibration in the calender.

SUMMARY OF THE INVENTION

It is accordingly a primary object of the present invention to provide a supercalender capable of being utilized as a component of a paper machine so that a separate supercalender is no longer indispensable.

A further object of the present invention is to provide a supercalender unit which is exceedingly versatile in its operating characteristics as well as in the various possibilities of use thereof, with such a supercalender of the invention being capable of accomplishing those tasks which are conventionally accomplished by conventional calendering, namely compaction of the web, achieving uniform web thickness in the cross-machine direction, controlling the web caliper, improving the smoothness of the web, improving the gloss of the web, and reducing those operating difficulties which occur during operation of the various types of calenders.

Thus, it is an object of the present invention to provide a calender which by reason of the arrangement of the rolls thereof enables the vibrations of the rolls to be damped while the above drawbacks are also reduced.

Thus, it is an object of the present invention to provide a supercalender which can be directly connected to a paper machine and which has a construction which enables pulling in of web into the calender at a high speed without any risk of damage to the filled rolls which have the resilient surfaces.

Furthermore, it is an object of the present invention to provide a calender roll arrangement which makes it easy to relieve the filled rolls of pressure so that damage to such rolls during shutdown of the calender operation can be avoided.

An additional object of the present invention is to provide a calender wherein the load which acts on the rolls can easily be controlled while a single calender may be utilized for the manufacture of various types of paper with the calender of the invention being flexible enough to enable the number of nips as well as the nip load to be easily and conveniently selected according to the requirements of each particular type of paper.

According to the invention the supercalender includes an upright series of metal rolls forming a stack which provides hard nips between these metal rolls. This stack of metal rolls includes top and bottom rolls as well as at least one pair of intermediate rolls situated between the top and bottom rolls and including an upper intermediate roll situated next to the top roll and a lower intermediate roll situated next to the bottom roll. At least one pair of filled rolls, preferably paper-coated rolls, are situated next to at least one of the pair of intermediate rolls to define therewith a pair of soft nips.

BRIEF DESCRIPTION OF DRAWINGS

The invention is illustrated by way of example in the accompanying drawings in which form part of this application and in which.

DESCRIPTION OF PREFERRED EMBODIMENTS

Figure 1:
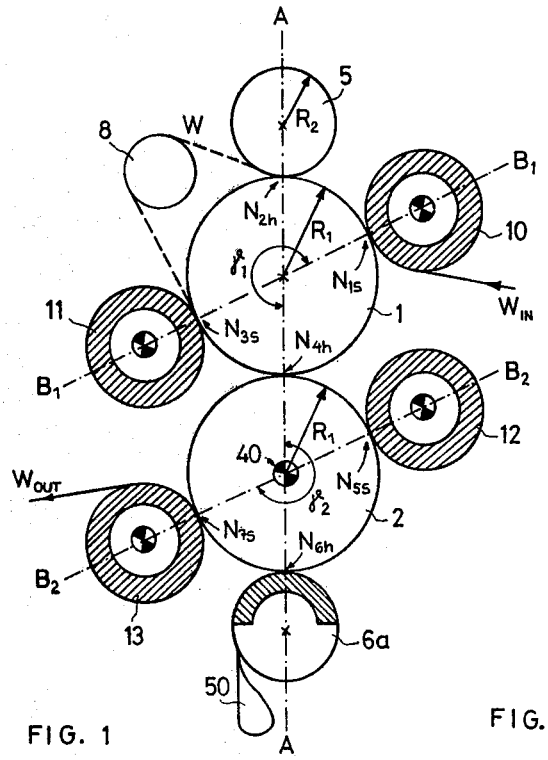
FIG. 1 is a diagrammatic representation of one embodiment of a calender according to the invention, this embodiment including four metal rolls and four filled rolls.
Figure 2A:
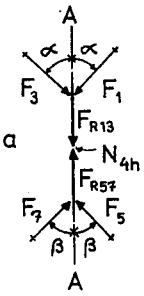
FIG. 2*a* is a force diagram illustrating how the embodiment of FIG. 2 operates.
Figure 2:
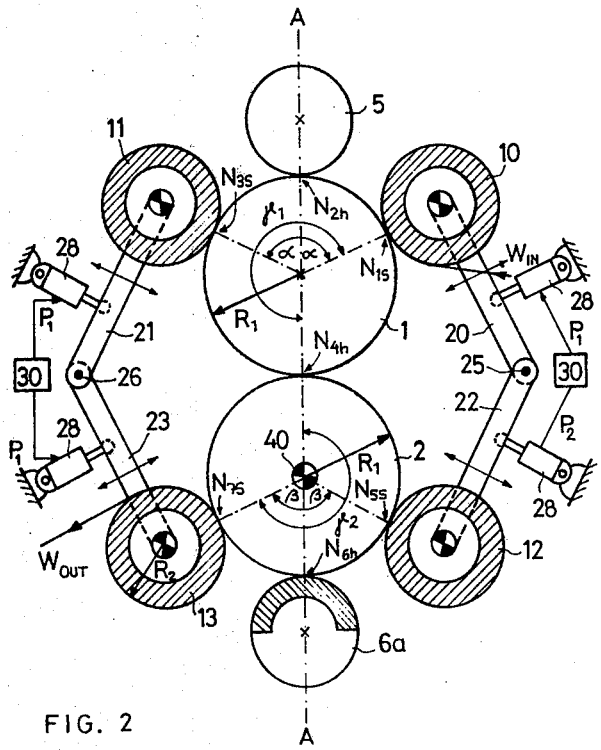
FIG. 2 is a diagrammatic representation of a further embodiment of the invention wherein the calender is the equivalent of that of FIG. 1 although the filled rolls are situated differently than in the embodiment of FIG. 1.

In the embodiments of the invention which are illustrated in FIGS. 1–4, the supercalender includes a stack formed by an upright series of hard or metal rolls of which there are four rolls defining between themselves hard nips. Thus, the upright series of metal or hard rolls, which may, for example, be die-cast rolls, includes a top roll 5, a bottom roll 6*a*, represented by the roll 6 in FIGS. 3 and 4, and a pair of intermediate rolls 1 and 2. The intermediate roll 1 is an upper intermediate roll situated next to the top roll 5 while the intermediate roll 2 is a lower intermediate roll situated next to the lower roll 6*a* of FIGS. 1 and 2, corresponding to the roll 6 indicated in FIGS. 3 and 4. It will be noted that the pair of intermediate rolls 1 and 2 have larger diameters than the top and bottom rolls. Thus, the intermediate rolls 1 and 2 each have a radius $R_1$ which for example is twice as great as the radius $R_2$ of the top roll 5 and also of the bottom roll 6*a* or 6. These larger diameter intermediate rolls provide sufficient space for a plurality of nips to be formed at the exterior surface of these intermediate rolls 1 and 2. The lower intermediate roll 2 is directly driven and for this purpose is operatively connected with a drive means 40 which is schematically indicated in FIGS. 1 and 2. The upper intermediate roll 1 is driven from the roll 2, by frictional engagement with a web travelling through the nip between the rolls 1 and 2 and in the same way the top roll 5 is driven from the roll 1 while the lower roll 6*a* or 6 is driven from the roll 2. The bearing structure for the lower intermediate roll 2 provides the latter with a fixed axis of rotation while the top and bottom rolls are supported for rotation by bearings which are free to move in a vertical direction in the plane A—A which contains the axes of the stack of metal rolls. The bottom roll 6*a* or 6 is provided with a loading means which is not illustrated and which functions to urge the bottom roll upwardly against the lower intermediate roll 2. Any one of the rolls, such as the intermediate roll 3 shown in FIGS. 5–7, may be provided with a known means for providing compensation for deflection of the roll. A doctor blade 50 is shown in FIG. 1 cooperating with the bottom roll 6*a*. It is to be noted that because of the relatively large diameter of the intermediate rolls 1 and 2, the deflection thereof is minimal.

The calender structures illustrated in FIGS. 1–4 also include filled rolls as are commonly used in supercalenders and which are in themselves known, the embodiments of FIGS. 1 and 2 including four filled rolls 10–13. Each of the filled rolls 10–13 is operatively connected with a moving means capable of moving each filled roll between a position where each filled roll is pressed toward one of the intermediate metal rolls for defining a soft nip therewith and a position spaced at least slightly from the metal roll to define therewith a space either when the calender is not operating or for the purpose of threading a web between the filled roll and the metal roll cooperating therewith. The several moving means operatively connected with the several filled rolls, respectively, include a plurality of lever means 20–23 respectively connected operatively with the several filled rolls to support the latter for rotation. The pair of lever means 20 and 22 which respectively support the filled rolls 10 and 12 for rotation are supported themselves for turning movement about a common pivot 25 which is stationary, and the pair of lever means 21 and 23 which respectively support the filled rolls 11 and 13 for rotation are themselves supported for turning movement by a stationary pivot 26. Each of these lever means has, as a further component of the moving means, a pressure means 28 operatively connected thereto. Thus each pressure means 28 may include a suitable cylinder having therein a piston the rod of which is pivotally connected with the particular lever means as illustrated schematically in FIG. 2. A suitable fluid under pressure such as air or oil is provided in the cylinder of each pressure means 28 by way of the unit 30 which may be a suitable pump communicating with a source of fluid and connected by suitable lines to the particular cylinder so as to control the pressure therein, this pressure being a pressure such as the pressure $P_1$ or $P_2$ as illustrated in FIG. 2. Thus, by way of this moving means made up of the above-described lever means and pressure means it is possible to provide a predetermined pressure between each filled roll and the metal roll cooperating therewith or it is possible to situate each filled roll at a position spaced from the metal roll for the purposes set forth above. Thus by way of the pressure means 28 it is possible to achieve between the filled rolls and the metal rolls a predetermined line pressure.

It will be noted that each of the filled rolls 10–13 has at its central region a symbol corresponding to the symbol 40 for the drive means of the lower intermediate roll 2, and these symbols designate a plurality of drive means respectively connected operatively to the filled rolls for driving the latter, these drive means for the filled rolls being adjustable so that it is possible to regulate the peripheral velocity of the filled rolls 10–13, as required. This adjustment may be such that each filled roll may have a speed less than, equal to, or greater than the speed of the metal roll with which it cooperates.

In the embodiment of FIG. 1 the filled rolls 10 and 11 are situated at diametrically opposed locations along the exterior surface of the upper intermediate roll 1. Thus, the angular distance between the filled rolls 10 and 11 is approximately 180°. The axes of the filled rolls 10 and 11 as well as the axis of the upper intermediate roll 1 and the soft nips $N_{1s}$ and $N_{3s}$ defined between the rolls 10 and 11 and intermediate roll 1 are all located in a common plane $B_1$—$B_1$ as indicated in FIG. 1. The filled rolls 12 and 13 cooperate in the same way with the lower intermediate roll 2 so that the axes of the rolls 12 and 13 together with the axis of the lower intermediate roll 2 and the soft nips $N_{5s}$ and $N_{7s}$ defined between the rolls 12 and 13 and the intermediate roll 2 are all located in a common plane $B_2$–$B_2$.

It will be seen that in the several figures the several nips are designated N with the numerical subscript indicating the sequential location of the particular nip while the subscript s indicates a soft nip and the subscript h indicates a hard nip. Thus, for example, referring to FIG. 1 it will be seen that the illustrated calender provides for the web W seven nips $N_1$–$N_7$ which are either soft or hard as designated by the subscripts s or h. For the sake of clarity in FIGS. 3–7 the several soft nips are indicated by an open circle while the several hard nips are indicated by a solid circle. Moreover, for the sake of clarity in FIGS. 3–7 the several filled rolls are indicated with hatch lines whereas the several metal rolls are indicated with open circles. Thus the combination of the rolls of the several calenders shown in FIGS. 3–7 becomes immediately apparent from a glance at any of these figures.

With the particular embodiment which is illustrated in FIG. 1, by way of the illustrated arrangement of the rolls the line pressures of the several soft nips are all equal, and with the illustrated arrangement the line pressures of the soft nips will have no influence on the nip pressures at the hard nips defined between the vertical stack of metal rolls.

The several figures indicate how the web W enters into the calender by the designation $W_{IN}$, and the manner in which the web W leaves the calender is indicated at $W_{OUT}$. Of course the sequence of nips through which the web travels is indicated by the above numerical subscripts. It will be seen that FIG. 1 differs from the schematic illustration of FIG. 3 in that an additional guide roll 8 is provided for the web W as it travels from the first hard nip to the second soft nip.

While the diametrically opposed arrangement of the filled rolls with respect to the metal rolls in FIG. 1 will eliminate any influence on the nips between the metal rolls from the filled rolls, with the embodiment of FIG. 2 there is a different arrangement in that each pair of filled rolls cooperating with a metal roll is not situated at diametrically opposed parts of each intermediate metal roll. Instead the pair of filled rolls 10 and 11 which cooperate with the upper intermediate roll 1 are situated at equal angles $\alpha$ about the axis thereof from the vertical plane A—A, and in the same way the lower pair of filled rolls 12 and 13 are situated at equal angles about the axis of the lower intermediate roll 2 from the plane A—A. Thus the equal angles $\beta$ for the lower pair of filled rolls are in the illustrated example equal to the equal angles $\alpha$ for the upper pair of filled rolls 10 and 11 of FIG. 2. These angles $\alpha$ and $\beta$ may vary within a range of about 30°–90°, and while the angle $\alpha$ may equal the angle $\beta$, this latter relationship is not essential.

FIG. 2*a* is a force diagram illustrating the distribution of nip pressure forces in the particular arrangement of FIG. 2. If by way of the pressure means 28 the pressure at the nips $N_{1s}$ and $N_{3s}$ are equal to each other, then the forces $F_1$ and $F_3$ of FIG. 2*a* are equal. In a similar way it it possible to provide equal forces $F_5$ and $F_7$ at the soft nips $N_{5s}$ and $N_{7s}$ of FIG. 2. It will be seen that the forces $F_1$ and $F_3$ provide a resultant force $F_{R13}$ while the forces $F_5$ and $F_7$ provide a resultant force $F_{R57}$. These resultant forces are directly opposed to each other and coincident with each other, being situated in the plane A—A, so that in the embodiment of FIG. 2 the forces at the soft nips add to the pressure at the hard nip $N_{4h}$ between the pair of intermediate metal rolls 1 and 2.

It is of course well understood that by changing the situation of the filled rolls 10–13 and the forces acting thereon it is possible to influence not only the soft nip pressures but also in a fairly wide and variable range the nip pressures of the hard nips. It thus follows that by varying the differential between the operating pressures at the soft nips and the ratio therebetween it is possible to influence the calendering action within very wide limits.

The pressure control devices have of course been schematically designated in FIG. 2. It is to be emphasized in this connection that in addition to the advantage of providing numerous nips with variable effects, the nips produced by way of the filled rolls also have the effect of reducing the likelihood of vibration of the metal rolls, thus reducing any possible detriments resulting from such vibration, and it is possible by varying the nip pressures and/or the position of the filled rolls 10–13 to contribute to the elimination of vibrations.

When initially threading the web through the calender, the filled rolls are displaced away from the metal rolls and the web W after first passing between the filled roll 10 and the upper intermediate roll 1 is delivered to the first hard nip $N_{2h}$. The web is then extended further around the upper intermediate roll 1 so as to reach the second hard nip $N_{4h}$, while passing between the filled roll 11 and the intermediate roll 1, and then the web is extended between the filled roll 12 and the lower intermediate roll 2 until it reaches the third hard nip $N_{6h}$, after which the web passes between the filled roll 13 and the lower intermediate roll 2, the web travelling beyond the location $W_{OUT}$ to an unillustrated reeling apparatus. After the running of the web through the hard nips has stabilized, the filled rolls 10 and 11 are pressed toward the upper intermediate roll 1 by way of the above-described moving means, and in a similar manner the filled rolls 12 and 13 are pressed toward the lower intermediate roll 2 in order to achieve the desired soft nip pressures.

Of course, in accordance with the particular paper which is being manufactured it may be possible or even be required to subject the web only to treatment with the hard nips, in which case the calender of the invention will operate in the same way as a normal machine calender having four rolls.

The end-of-web introducing procedure described above enables the operator to avoid damage to the delicate filled rolls 10–13 from "paper cuds" passing through the stack of rolls.

Figure 3:
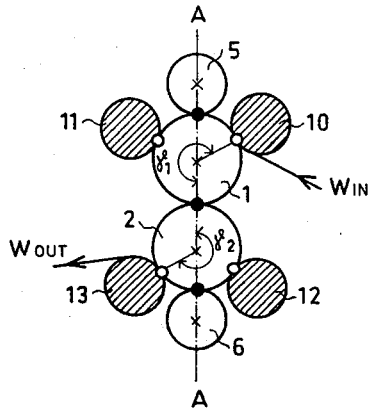
FIG. 3 is a schematic representation of the embodiment of FIG. 2.
Figure 4:
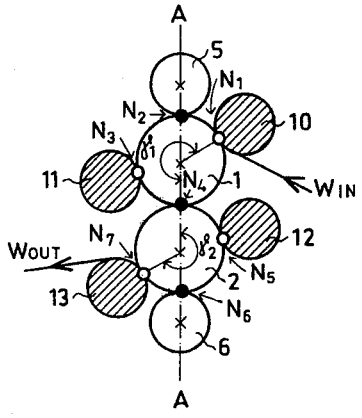
FIG. 4 is a schematic representation of the embodiment of FIG. 1.

As is apparent from FIGS. 1 and 2, as well as FIGS. 3 and 4, with these embodiments of the invention while the web travels through the calender it is subjected to a series of soft nips and a series of hard nips which respectively alternate with the soft nips. Thus, as compared with a supercalender in which all the nips are soft nips, the structure of the invention provides the advantage of enabling the web to be "calibrated" between the hard nips so that it is possible to achieve in this way a better and more uniform gloss than with a conventional supercalender.

Figure 5:
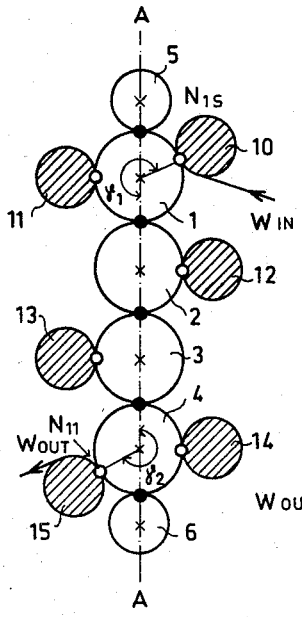
FIGS. 5–7 schematically represent respectively, additional possible embodiments of the invention wherein there are six metal rolls, the purpose of the schematic illustrations of FIGS. 3–7 being to provide an immediate comparison of different possible variations of the invention.
Figure 6:
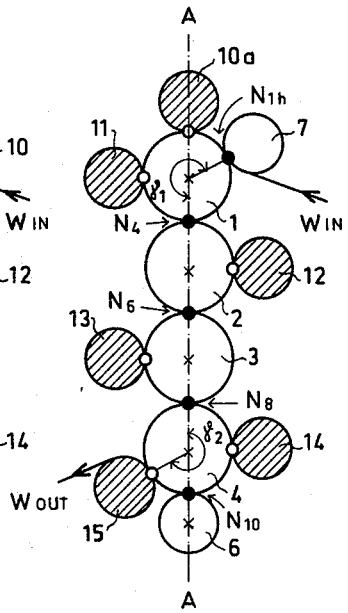
Figure 7:
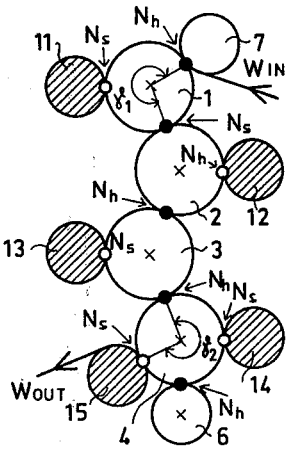

FIGS. 3–7 illustrate various possibilities of calender constructions according to the invention in a schematic manner, FIG. 3 corresponding to the structure of FIG. 2 while FIG. 4 corresponds to the structure of FIG. 1. FIGS. 5–7 illustrate that it is possible to add to the metal rolls of FIG. 4 a pair of additional metal intermediate rolls 3 and 4 of large diameter. The filled rolls 13–15 provide soft nips at these additional intermediate rolls 3 and 4 in the manner illustrated in FIGS. 5–7.

As is shown in FIG. 5, it is possible with the invention to provide a twelve-roll calender providing for the web a series of soft nips and a series of hard nips which respectively alternate with the soft nips.

It is required to include in the roll stack of the calender of the invention at least one hard nip in association with the upper intermediate roll for the purpose of pulling through the end of the web W so that it will enter into the calender. However, the hard nip which introduces the web into the calender need not be situated at the uppermost part of the calender. Thus FIG. 6 shows an arrangement where the top metal roll 7 is situated at an elevation lower than the highest filled roll 10a, this particular embodiment differing from the others in that the first hard nip $N_{1h}$ is followed by a pair of soft nips which are then followed by hard and soft nips which alternate with each other as illustrated in FIG. 6.

The embodiment of FIG. 7 differs from that of FIG. 6 in that the upright series of metal rolls which directly engage each other to provide the series of hard nips, as is the case with all of the embodiments, are arranged in such a way that their axes are not located in a common vertical plane. Moreover, it will be seen that in the embodiment of FIG. 7 the highest filled roll 10a of FIG. 6 has been omitted. Thus the upper intermediate roll 1 of FIG. 7 cooperates only with one filled roll 11 to provide one soft nip at the upper intermediate roll 1 of FIG. 7. Furthermore, in FIGS. 6 and 7 the first nip is a hard nip followed in the case of FIG. 6 by two soft nips. Thus with the embodiment of FIG. 6 with respect to the first three nips the alternating of the hard and soft nips is not present, and such an arrangement may be desirable in some cases. Thus, it is sometimes of advantage if in the continuous operation the first nip is a hard nip because the paper is relatively uneven after drying, and viewed in its entirety the supercalendering of FIGS. 6 and 7 may be more efficient for certain types of paper.

With the zig-zag arrangement of the metal rolls, particularly as shown in FIG. 7, it is possible also to reduce the likelihood of vibration of the calender.

Thus, by way of the present invention it is possible to provide at least four soft nips in association with the upper and lower intermediate rolls of the calender stack, and in fact each upper and each lower intermediate roll can provide with its associated rolls a series of four nips two of which are hard and two of which are soft. As a result, the web W will run around the surface of an upper or lower intermediate roll through a considerable angle, this result being achieved at least in part from the fact that the metal intermediate rolls of the embodiments have, particularly at the upper and lower intermediate rolls, a diameter substantially greater than the diameter of the filled rolls and/or of the top and bottom rolls of the calender stack, this larger diameter of the intermediate rolls being approximately twice the diameter of the filled rolls and the top and bottom metal rolls. These metal rolls are most appropriately die-cast rolls, and the bottom rolls 6, 6a as well as the filled rolls 10–15 may be properly deflection-compensated. The intermediate metal roll 2 is preferably driven and has a stationary axis while the remaining metal rolls are movable in a vertical direction with the bottom rolls 6, 6a being loaded so as to be urged upwardly from below.

Furthermore, with respect the advantageous mutual cooperation between the rolls and the various angles shown in the drawings, the cental angle $\gamma_1$ from the first to the last nip at the upper intermediate roll and the central angle $\gamma_2$ from the first to the last nip at the lower intermediate roll of each embodiment is always in excess of 180°, preferably 220°–270°. The angles $\alpha$ and $\beta$ (FIG. 2) are preferably, though not necessarily, equal, and most advantageously approximately 60°.

It is furthermore to be noted that the calender of the invention may be used separately from the paper machine in the manner of a normal supercalender. With respect to the particular roll diameters and line pressures which are utilized, these magnitudes depend, for example, upon such factors as the machine speed and the machine breadth.

An advantageous variant of the embodiment of FIG. 7 is one in which the intermediate rolls 1–4 are angularly offset one with respect to the next so as to provide, for example, in FIG. 7 a hard nip between the lower pair of intermediate rolls 3 and 4 and the soft nips provided at these rolls 3 and 4 by way of the filled rolls 13 and 14 all of which are located in a common plane. This arrangement is of advantage in connection with self-stabilizing and utilizing relatively high line pressures. In order to achieve balancing and equilibrium of forces, it is moreover possible to provide at least the intermediate rolls 2 and 3 of FIGS. 5–7 with auxiliary rolls which are not illustrated and which are situated respectively opposite the filled rolls 12 and 13 pressing against the intermediate rolls 2 and 3 of FIGS. 5–7. Such rolls may in addition serve as cleaning rolls and they enable higher lines pressures to be utilized.

Of course the invention is not intended to be limited to the details set forth above and shown in the drawings, inasmuch as these details may vary within the scope of the inventive idea defined by the claims which follow below.

What is claimed is:

1. In a supercalender, an upright series of metal rolls defining between themselves a plurality of hard nips and including top and bottom end rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, so that a web travelling around said one intermediate roll between the latter and said two filled rolls and between said one intermediate roll and one of said end rolls will be subjected at said one intermediate roll to at least three nips at least one of which is a hard nip defined between said one end roll and said one intermediate roll and the other two of which are soft nips defined between said two filled rolls and said one intermediate roll.

2. The combination of claim 1 and including at least one additional filled roll situated next to the other of said pair of intermediate rolls for defining therewith an additional soft nip.

3. The combination of claim 2 and wherein there are four filled rolls two of which are situated next to one of said pair of intermediate rolls and the other two of which are situated next to the other of said pair of intermediate rolls for defining therewith four soft nips.

4. In a supercalender, an upright series of metal rolls defining between themselves a plurality of hard nips and including top and bottom rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, each of said pair of intermediate rolls having a diameter substantially larger than the diameter of each filled roll.

5. The combination of claim 4 and wherein the diameter of each intermediate roll is also substantially greater than the diameter of each of said top and bottom rolls.

6. The combination of claim 5 and wherein the diameter of each intermediate roll is approximately twice the diameter of the filled rolls and the top and bottom rolls.

7. The combination of claim 1 and wherein the filled rolls respectively have a pair of axes, and the latter axes together with the soft nips between said filled rolls and said one of said pair of intermediate rolls and together with the axis of said one intermediate roll are all situated in a common plane.

8. The combination of claim 1 and wherein said one of said pair of intermediate rolls defines with the filled rolls and with the metal rolls situated next to said one of said pair of intermediate rolls a series of nips through which a web travels sequentially when engaging said one of said pair of intermediate rolls, and said series of nips including a first nip and a last nip which are angularly spaced from each other around the axis of said one of said pair of intermediate rolls by an angle which is greater than 180°.

9. The combination of claim 8 and wherein said angle is in a range of from 220°-270°.

10. The combination of claim 1 and wherein said one of said pair of intermediate rolls defines with said pair of filled rolls and with the metal rolls situated next to said one of said pair of intermediate rolls a series of nips through which a web sequentially travels when engaging said one of said pair of intermediate rolls, and said series of nips including a plurality of soft nips and a plurality of hard nips which respectively alternate with said soft nips.

11. The combination of claim 1 and wherein a moving means is operatively connected with each of said filled rolls for moving the same between a position situated directly next to said one of said pair of intermediate rolls of defining therewith a soft nip and a position spaced at least slightly from said one of said pair of intermediate rolls for defining a space therewith either when the supercalender is not operating or for threading a web between each filled roll and said one of said pair of intermediate rolls.

12. The combination of claim 11 and wherein said moving means includes a lever means supporting each filled roll for rotary movement.

13. In a supercalender, an upright series of metal rolls defining between themselves a plurality of hard nips and including top and bottom rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, moving means operatively connected with each of said filled rolls for moving the same between a position situated directly next to said one of said pair of intermediate rolls for defining therewith a soft nip and a position spaced at least slightly from said one of said pair of intermediate rolls for defining a space therewith either with the supercalender is not operating or for threading a web between each filled roll and said one of said pair of intermediate rolls, said moving means including a lever means supporting each filled roll for rotary movement, said moving means also including a pressure means operatively connected with each lever means for moving the latter and for determining the pressure between each filled roll and said one of said pair of intermediate rolls when each filled roll is in said position directly next to said one of said pair of intermediate rolls.

14. The combination of claim 1 and wherein there are four filled rolls two of which are situated next to one of said pair of intermediate rolls and two of which are situated next to the other of said pair of intermediate, rolls, and all of said four filled rolls defining with said pair of intermediate rolls four nips all of which are situated at equal angular distances from a plane containing the axes of said intermediate rolls about the axis of one or the other of said intermediate rolls.

15. The combination of claim 14 and wherein said equal angles are on the order of 60 degrees.

16. In a supercalender, an upright series of metal rolls defining between themselves a plurality of hard nips and including top and bottom rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, said filled rolls including four filled rolls two of which are situated next to one of said pair of intermediate rolls and two of which are situated next to the other of said pair of intermediate rolls, and all of said four filled rolls defining with said pair of intermediate rolls four nips all of which are situated at equal angular distances from a plane containing the axes of said intermediate rolls about the axis of one or the other of said intermediate rolls, said four filled rolls forming two pairs of filled rolls respectively situated on opposite sides of said plane, and the filled rolls on each side of said plane being situated from each other at a distance greater than the axes of said intermediate rolls so that the pressure of said filled rolls acting toward said intermediate rolls urges the latter toward each other.

17. The combination of claim 1 and wherein a drive means the speed of which can be adjusted is operatively connected with each filled roll.

18. The combination of claim 1 and wherein at least one additional intermediate metal roll is situated between said pair of intermediate rolls and defines at least one additional hard nip with one of said pair of intermediate rolls, and at least one additional filled roll situated next to said additional intermediate roll and defining an additional soft nip therewith.

19. The combination of claim 18 and wherein all of said metal rolls respectively have axes situated in a common vertical plane.

20. In a supercalender, an upright series of metal rolls defining between themselves a plurality of hard nips and including top and bottom rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, all of said metal rolls except said top roll having axes situated in a common vertical plane.

21. In a supercalender, an upright series of metal rolls defining between themselves a plurality of hard nips and including top and bottom rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, at least one additional intermediate metal roll situated between said pair of intermediate rolls and defining at least one additional hard nip with one of said pair of intermediate of intermediate rolls, and at least one additional filled roll situated next to said additional intermediate roll and defining an additional soft nip therewith, all of said metal rolls except said top roll having axes situated in a common vertical plane, said two filled rolls being situated next to said lower intermediate roll while a further pair of filled rolls are situated next to said upper intermediate roll along the path of web travel between said top roll and said additional intermediate roll which is situated between said pair of intermediate rolls.

22. In a supercalender, an upright series of metal rolls defining between themselves a plurality of hard nips and including top and bottom rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, each of said metal rolls having an axis which is offset with respect to the next metal roll and said axes of said metal rolls being sequentially offset in opposite directions one with respect to the next so that in a plane normal to the axes of said metal rolls the axes thereof are situated along a zigzag path.

23. In a supercalender, an upright series of metal rolls defining between themselves a plurality of hard nips and including top and bottom rolls and between the latter at least a pair of intermediate rolls one of which is an upper intermediate roll situated next to said top roll and the other of which is a lower intermediate roll situated next to said bottom roll, and at least two filled rolls situated next to at least one of said pair of intermediate rolls and defining therewith a pair of soft nips, at least one additional intermediate metal roll situated between said pair of intermediate rolls and defining at least one additional hard nip with one of said pair of intermediate rolls, and at least one additional filled roll situated next to said additional intermediate roll and defining an additional soft nip therewith, each of said metal rolls having an axis which is offset with respect to the next metal roll and said axes of said metal rolls being sequentially offset in opposite directions one with respect to the next so that in a plane normal to the axes of said metal rolls the axes thereof are situated along a zigzag path, a hard nip between two of said intermediate rolls and the soft nips between the latter two intermediate rolls and two of said filled rolls which are situated next to said two intermediate rolls all being located in a common plane.

* * * * *